US008186677B2

(12) United States Patent
Motoi et al.

(10) Patent No.: US 8,186,677 B2
(45) Date of Patent: May 29, 2012

(54) SHEET STACKING DEVICE, SHEET PROCESSING DEVICE, AND IMAGE FORMING APPARATUS

(75) Inventors: Norio Motoi, Moriya (JP); Kenji Toppada, Noda (JP); Hiroki Hommochi, Moriya (JP); Yoshihiko Kitahara, Ushiku (JP)

(73) Assignee: Canon Finetech Inc., Misato-shi (JP)

( * ) Notice: Subject to any disclaimer, the term of this patent is extended or adjusted under 35 U.S.C. 154(b) by 0 days.

(21) Appl. No.: 12/892,394

(22) Filed: Sep. 28, 2010

(65) Prior Publication Data

US 2011/0079955 A1 Apr. 7, 2011

(30) Foreign Application Priority Data

Oct. 2, 2009 (JP) ..... 2009-231017

(51) Int. Cl.
*B65H 39/10* (2006.01)
*B65H 31/04* (2006.01)

(52) U.S. Cl. ..... 271/293; 271/213

(58) Field of Classification Search ..... 271/213, 271/214, 217, 292, 293, 298, 294; 270/58.13, 270/58.15, 58.19, 58.28
See application file for complete search history.

(56) References Cited

U.S. PATENT DOCUMENTS

| | | | | |
|---|---|---|---|---|
| 3,721,435 | A * | 3/1973 | Zanders | 271/293 |
| 5,011,130 | A * | 4/1991 | Naito et al. | 271/288 |
| 5,090,673 | A * | 2/1992 | Kitahara et al. | 270/58.19 |
| 6,206,366 | B1 * | 3/2001 | Schmid | 271/217 |
| 6,276,677 | B1 | 8/2001 | Hommochi et al. | |
| 6,779,790 | B2 | 8/2004 | Kitahara | |
| 7,354,034 | B2 | 4/2008 | Nakamura et al. | |
| 7,543,806 | B2 | 6/2009 | Nakamura et al. | |
| 2005/0062224 | A1 * | 3/2005 | Peeters et al. | 271/293 |
| 2005/0236764 | A1 * | 10/2005 | Saeki et al. | 271/293 |
| 2007/0278732 | A1 | 12/2007 | Kitahara | |
| 2010/0258995 | A1 | 10/2010 | Okamoto et al. | |

FOREIGN PATENT DOCUMENTS

| | | |
|---|---|---|
| JP | 2003-95513 | 4/2003 |
| JP | 2008-114984 | 5/2008 |

OTHER PUBLICATIONS

Translation of Japanese Office Action dated Sep. 13, 2011, issued by the Japanese Patent Office, in Japanese Patent Application No. 2009-231017.

* cited by examiner

*Primary Examiner* — Kaitlin Joerger
*Assistant Examiner* — Patrick Cicchino
(74) *Attorney, Agent, or Firm* — Fitzpatrick, Cella, Harper & Scinto

(57) ABSTRACT

In order to stack a larger number of sheets on trays by reducing a total thickness of the trays and enabling the trays to ascend and descend actually over long distances, a sheet stacking device includes an upper-tray and a lower-tray which are ascendible and descendible and on which sheets delivered from a delivery roller pair are stacked, a motor and a belt for allowing both the trays to ascend and descend, a clutch for disconnecting the upper-tray and the belt from each other, and a claw and a rack for stopping self-weight descent of the upper-tray when the clutch effects the disconnection. A clearance between the upper-tray under the disconnection by the clutch and in the stop of the self-weight descent by the claw engaged with the rack and the lower-tray connected to the belt is adjustable by ascent and descent of the lower-tray by the motor.

3 Claims, 9 Drawing Sheets

SHEET STACKING DEVICE, SHEET PROCESSING DEVICE, AND IMAGE FORMING APPARATUS

BACKGROUND OF THE INVENTION

1. Field of the Invention

The present invention relates to a sheet stacking device in which sheets are stacked, a sheet processing device which stacks processed sheets into the sheet stacking device, and an image forming apparatus which stacks sheets subjected to image formation into the sheet stacking device provided to an apparatus main body of the image forming apparatus.

2. Description of the Related Art

Conventional image forming apparatuses, such as copiers, laser beam printers, inkjet printers, facsimiles, and composite apparatuses of those devices have a sheet stacking device which is provided to an apparatus main body thereof and in which sheets subjected to image formation are stacked.

As a stacking unit for stacking sheets subjected to image formation which are delivered from a sheet delivery portion, the sheet stacking device has ascendible and descendible trays provided on multiple stages. Each of the trays on the multiple stages includes a motor, and ascends and descends (refer to Japanese Patent Application Laid-Open No. 2008-114984).

In conventional sheet stacking devices, a motor is provided to each of the trays on the multiple stages. Thus, the total thickness in an ascending and descending direction of the trays is increased, and hence the trays are ascendible and descendible actually over only short distances. This has led to a problem in that a small number of sheets are stacked on the trays.

SUMMARY OF THE INVENTION

The present invention provides a sheet stacking device including thinner trays, in which the trays are ascendible and descendible actually over long distances, and in which a larger number of sheets can be stacked on the trays.

A sheet stacking device of the present invention includes: a plurality of stacking portions which are ascendible and descendible and on which sheets delivered from a sheet delivery portion are stacked; a drive portion configured to ascend and descend the stacking portions; an interrupting portion provided between at least one of the stacking portions and the drive portion, and configured to disconnect the at least one of the stacking portions and the drive portion from each other; and a descent stop portion configured to stop self-weight descent of the at least one of the stacking portions under the disconnection from the drive portion by the interrupting portion.

A sheet processing device of the present invention includes: a sheet processing portion configured to process sheets; and the sheet stacking device in which the sheets processed by the sheet processing portion are stacked.

An image forming apparatus of the present invention includes: an image forming portion configured to form images on sheets; and the sheet stacking device in which the sheets subjected to image formation by the image forming portion are stacked.

In the sheet stacking device of the present invention, a clearance between one of the stacking portions under the disconnection from the drive portion by the interrupting portion and in the stop of the self-weight descent by the descent stop portion and another of the stacking portions allowed to ascend and descend by the drive portion is adjustable by ascent and descent of the other stacking portion. The drive portion is shared by the stacking portions. Thus, it is unnecessary to provide a drive portion to each of the stacking portions, and possible to reduce the total thickness of the stacking portions in an ascending and a descending direction. As a result, a clearance between the stacking portions can be increased, and a larger number of sheets can be stacked.

The sheet processing device of the present invention includes the sheet stacking device in which a larger number of sheets can be stacked. Thus, sheets are less frequently taken out from the stacking portions, and hence the sheet processing device can be more easily handled.

The image forming apparatus of the present invention includes the sheet stacking device in which a larger number of sheets can be stacked. Thus, sheets are less frequently taken out from the stacking portions, and hence the sheet processing device can be more easily handled.

Further features of the present invention will become apparent from the following description of exemplary embodiments with reference to the attached drawings.

DESCRIPTION OF THE EMBODIMENT

In the following, with reference to the drawings, description is made of a sheet stacking device according to an embodiment of the present invention, a sheet processing device including the sheet stacking device, and an image forming apparatus with an apparatus main body including the sheet processing device.

Figure 1:
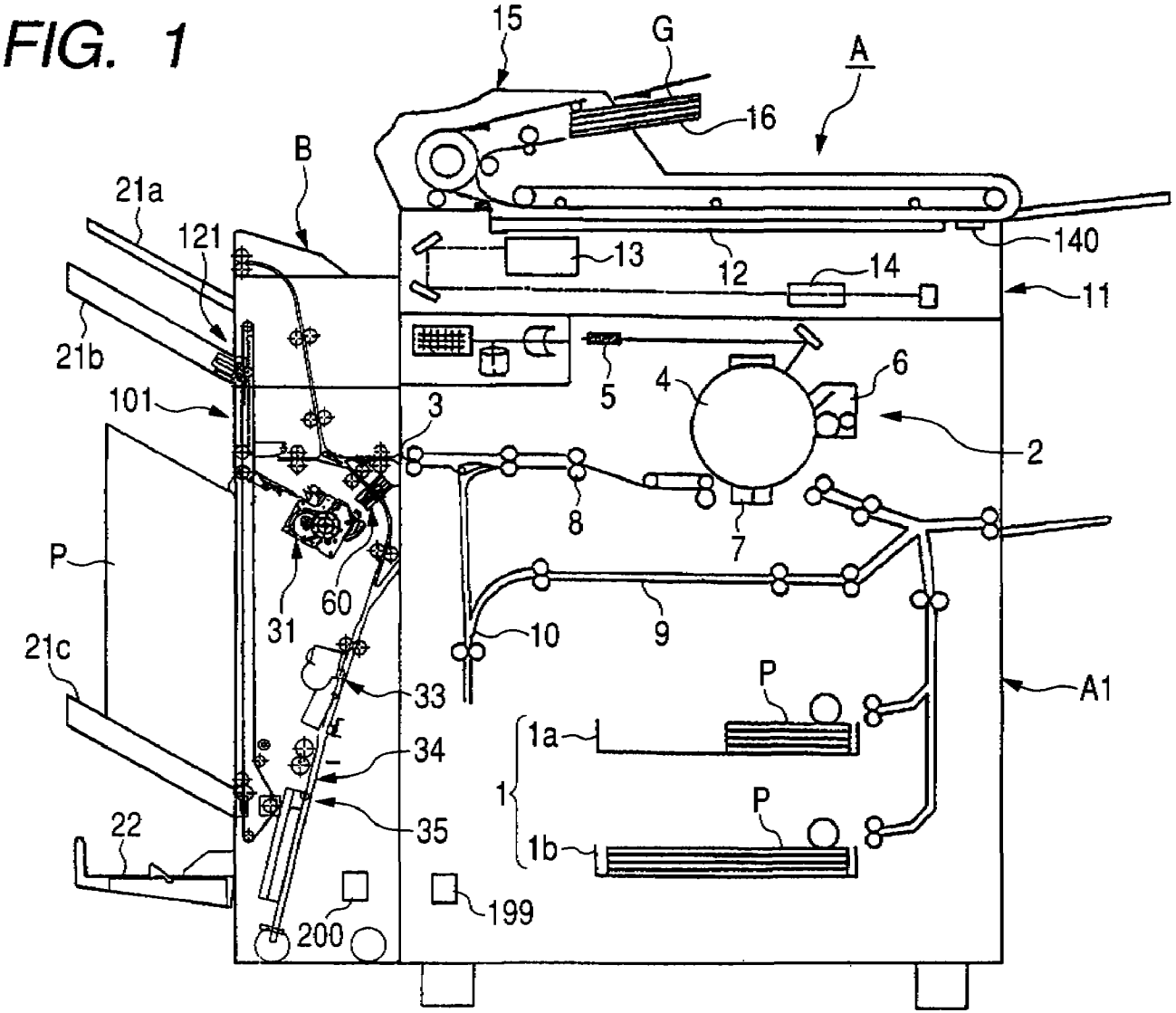
FIG. 1 is a sectional view taken along a sheet conveying direction in a sheet processing device and an image forming apparatus which have a sheet stacking device according to an embodiment of the present invention.

FIG. 1 is a sectional view taken along a sheet conveying direction in the image forming apparatus with the apparatus main body including the sheet processing device according to the embodiment of the present invention.

In FIG. 1, an image forming apparatus A includes an apparatus main body A1 of the image forming apparatus A, a sheet processing device B connected to a side of the apparatus main body A1, and an image reading device 11 provided above the apparatus main body A1. Although the sheet processing device B includes a sheet stacking device 101, an edge biding stapler 31, a book binding device 35, and a punching unit 60, and detachably connected as an option with respect to the apparatus main body A1, the sheet processing device B may be incorporated in the apparatus main body A1. Alternatively, without the sheet processing device B, the image forming apparatus A may include the sheet stacking device 101 in the apparatus main body A1 thereof, and sheets subjected to image formation may be stacked in the sheet stacking device 101. The image reading device 11 is not essential.

The apparatus main body A1 of the image forming apparatus includes an image forming portion 2 and a sheet feeding portion 1. Sheets P are sent from the sheet feeding portion 1 to the image forming portion 2. The sheets P are subjected to image formation in the image forming portion 2, and then delivered from a sheet delivery port 3. Among the sheets P which have different sizes and are accommodated in sheet feeding cassettes 1*a* and 1*b*, the sheet feeding portion 1 feeds designated sheets P to the image forming portion 2 while separating the sheets one by one. The image forming portion 2 includes, for example, a photosensitive drum 4, a printing head (laser-beam emitter) 5 arranged near the photosensitive drum 4, a developer 6, a transfer charger 7, and a fixing device 8.

The image reading device 11 scans an original set on a platen 12 with a scanning unit 13, and electrically reads the original with photoelectric conversion elements (not shown). Further, the image reading device 11 includes a feeding device 15 for feeding originals G accommodated in a stack tray 16 onto the platen 12. Images of the originals are read by scanning of the originals G fed onto the platen 12 with the scanning unit 13. The image data read by the image reading device 11 is, for example, subjected to digital processing in an image processing portion, and then transferred to a data storage portion 14. Image signals are sent to the laser-beam emitter 5.

The laser-beam emitter 5 applies a laser beam onto the photosensitive drum 4 according to the received image signals and forms an electrostatic latent image on the photosensitive drum 4. The electrostatic latent image is developed into a toner image through toner development by the developer 6. After that, the toner image is transferred onto the sheet by the transfer charger 7. The sheet P onto which the toner image is transferred is heat-pressed by the fixing device 8, and the toner image is fixed thereonto. The sheet P onto which the toner image is fixed is sequentially conveyed out into the sheet processing device B from the sheet delivery port 3.

In FIG. 1, a circulation path 9 is a path for image formation on a back surface side of the sheet P. Upon image formation on both surfaces of the sheet, the sheet P subjected to image formation on a front surface side thereof by the fixing device 8 is front-back reversed in a switchback path 10, and re-fed to the image forming portion 2. The sheet P having images formed on both sides thereof by the circulation path 9 is conveyed out into the sheet processing device B from the sheet delivery port 3.

Figure 2:
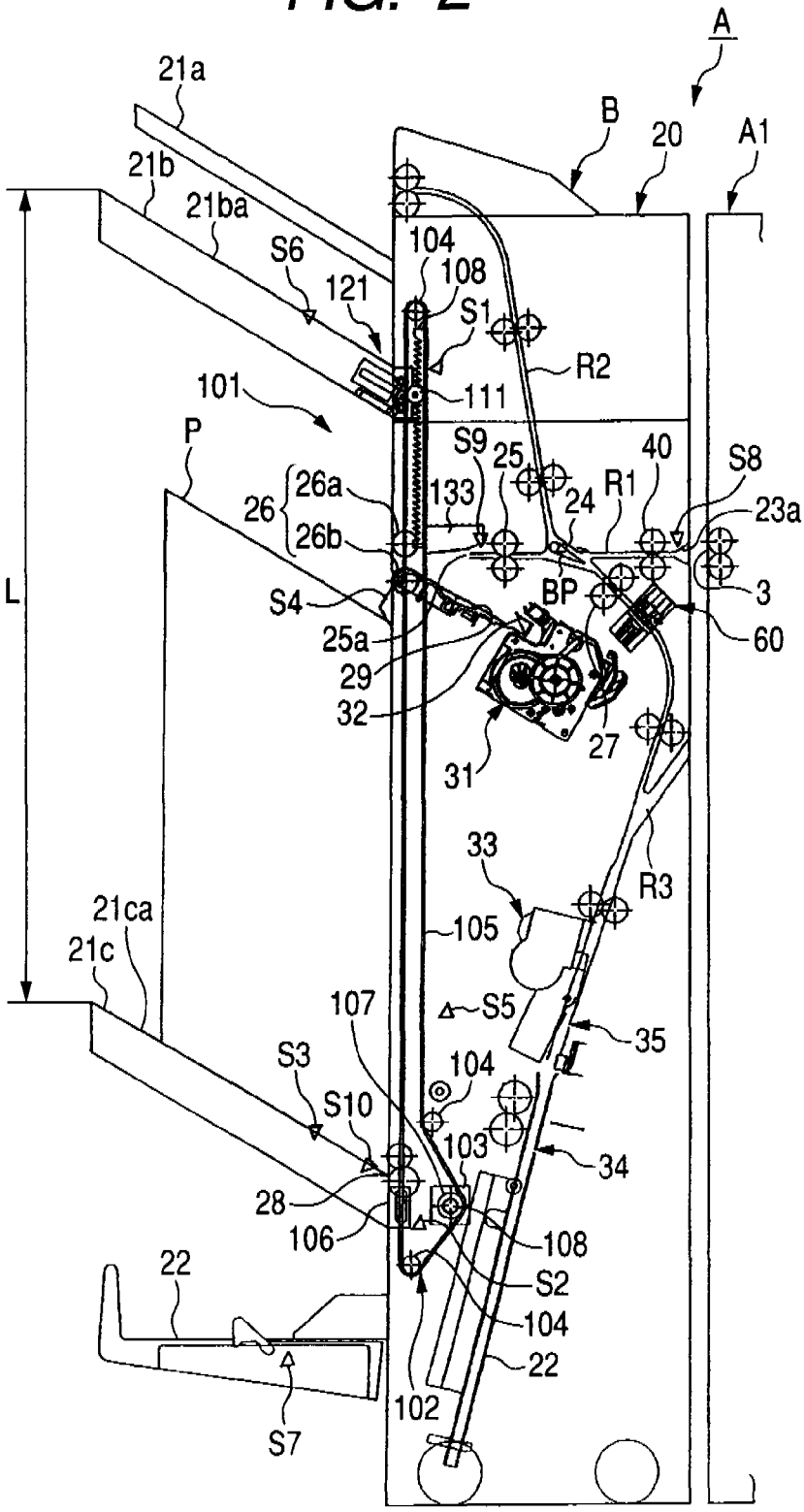
FIG. 2 is a sectional view taken along the sheet conveying direction in the sheet processing device.

In FIG. 2, the sheet processing device B is capable of sequentially taking in sheets conveyed out from the apparatus main body A1 according to modes set in the apparatus main body A1 of the image forming apparatus A, and selectively performing four processes of an alignment process, a stapling process, a punching process, and a book binding process.

In the alignment process, a side edge and trailing edge (right edge of FIG. 2) of each of the sheets stacked on a processing tray 29 described later are aligned by a delivery roller pair 26, side alignment plates (not shown), and a stopper 32. In the stapling process, the sheet bundle subjected to the alignment process on the processing tray 29 is stapled (bound) by the edge binding stapler 31 as a sheet processing unit. In the punching process, holes are bored in the sheet by the punching unit 60 as a sheet processing unit. In the book binding process, the sheet bundle held lengthwise on a saddle 22 is stapled at an intermediate part thereof by a middle binding stapler 33, and then folded by a folding device 34. In this manner, the sheet bundle is bound as a book. The saddle 22, the middle binding stapler 33, and the folding device 34 constitute the book binding device 35 as a sheet processing unit.

When delivering the sheets subjected to image formation as they are, the sheet processing device B delivers the sheets onto a sample tray 21*a*. When performing any one of the alignment process, the stapling process, and the punching process, the sheet processing device B delivers the processed sheets onto an upper-tray 21*b* or a lower-tray 21*c*. Then, when performing the book binding process, the sheet processing device B delivers the sheet bundle as a book onto the saddle 22 with a book binding delivery roller pair 28.

A carry-in port 23*a* of the sheet processing device B faces the sheet delivery port 3 of the apparatus main body A1 of the image forming apparatus A. A casing 20 of the sheet processing device B is provided with a first carry-in path R1 linearly extending from the carry-in port 23*a* in a manner of crossing the casing. The first carry-in path R1 is branched into a second carry-in path R2 for guiding sheets conveyed from the carry-in port 23*a* onto the sample tray 21*a* and a third carry-in path R3 for guiding the sheets into the book binding device 35. A path switching member 24 is provided at a branch point BP and tilts according to set modes so as to guide the sheets from the carry-in port 23*a* directly onto the processing tray 29 or into any one of the second carry-in path R2 and the third carry-in path R3.

The third carry-in path R3 is a path for guiding the sheets into the book binding device 35, and functions, during the stapling process performed on the processing tray 29, also as a standby portion for temporarily retaining a subsequent sheet sent from the sheet carry-in port 23*a*. That is, the subsequent sheet sent thereto during the stapling process is switchback-conveyed from the first carry-in path R1 into the third carry-in path R3 by a conveying roller pair 25 and a buffer roller pair 27, and held in the third carry-in path R3. Multiple subsequent sheets are held according to stapling-process time periods. When the sheet bundle subjected to the stapling process on the processing tray 29 is delivered, the multiple subsequent sheets are conveyed onto the processing tray 29 by the buffer roller pair 27 and the conveying roller pair while being superimposed on each other. The buffer roller pair 27 and the conveying roller pair 25 are constituted as a forward-and-reverse-rotatable sheet conveying portion for conveying, when a hole punching operation is performed, the sheets passing the branch point BP in a reverse direction and carrying the sheets into the third carry-in path R3.

The sheets to be subjected to punching are carried into the third carry-in path R3 and subjected to punching by the punching unit 60.

The processing tray 29 is arranged below a terminal end 25*a* of the first carry-in path R1. The edge biding stapler 31 for stapling an edge of the sheet bundle, and the like are provided on an upstream side in a sheet delivering direction of the processing tray 29 (right side of FIG. 2).

The processing tray 29 inclines so that the upstream side in the sheet delivering direction thereof is lowered. At an upstream end on the upstream side in the sheet delivering direction of the processing tray 29, the stopper 32 is provided for receiving trailing edges as edges on the upstream side in the sheet delivering direction of the delivered sheets so as to regulate positions of the sheets in the sheet delivering direction. The sheets stacked onto the processing tray 29 are received at the trailing edges thereof by the stopper 32 due to the delivery roller pair 26 and inclination of the processing tray 29. The trailing edges of the sheets positioned at a stapling position are stapled by the edge biding stapler 31.

The delivery roller pair 26 is constructed by a fixed roller 26*b* provided at a downstream end portion of the processing tray 29 and a movable roller 26*a* provided to a rocking guide 133 rockably provided above the processing tray 29 so that the movable roller 26*a* moves toward and away from the fixed roller 26*b*. In a state in which the movable roller 26*a* is away from the fixed roller 26*b*, the sheets are received onto the processing tray 29 and nipped by the movable roller 26*a* and the fixed roller 26*b*. Then, the movable roller 26*a* is rotated so as to bring the trailing edges of the sheets into contact with the stopper 32. As a result, both of side edge portions of the sheets are aligned by the side alignment plates (not shown) provided to the processing tray 29. Those operations are repeated every time the sheets are stacked onto the processing tray 29. As a result, the bundled sheets (sheet bundle) are subjected to the alignment process. The delivery roller pair 26 is reversely rotated so as to deliver the sheets onto the upper-tray 21*b* or the lower-tray 21*c*. The delivery roller pair 26 constitutes a sheet delivery portion for delivering the sheets.

The upper-tray 21*b* and the lower-tray 21*c* of the sheet processing device B are capable of ascending and descending by being guided by a guide mechanism (not shown) provided to the casing 20 in upper and lower directions.

In the following, description is made of the sheet stacking device 101 including the upper-tray 21*b* as a stacking unit and an upper stacking unit and the lower-tray 21*c* as a stacking unit and a lower stacking unit.

The sheet stacking device 101 includes a common drive source 102 for allowing the upper-tray 21*b* and the lower-tray 21*c* to ascend and descend. The drive source 102 as a drive unit includes a forward-and-reverse-rotatable motor 103, multiple sheaves 104, and a belt 105 which is rotated by a drive roller 107 provided to the motor 103 and is guided by the sheaves 104. The drive roller 107 provided to the motor 103 is provided with a brake 108, the brake 108 preventing unnecessary rotation of the belt 105.

The lower-tray 21*c* is fixed (coupled) by a bracket 106 directly to the belt 105. Thus, the lower-tray 21*c* is always ascendible and descendible according to rotation of the belt 105.

Figure 3:
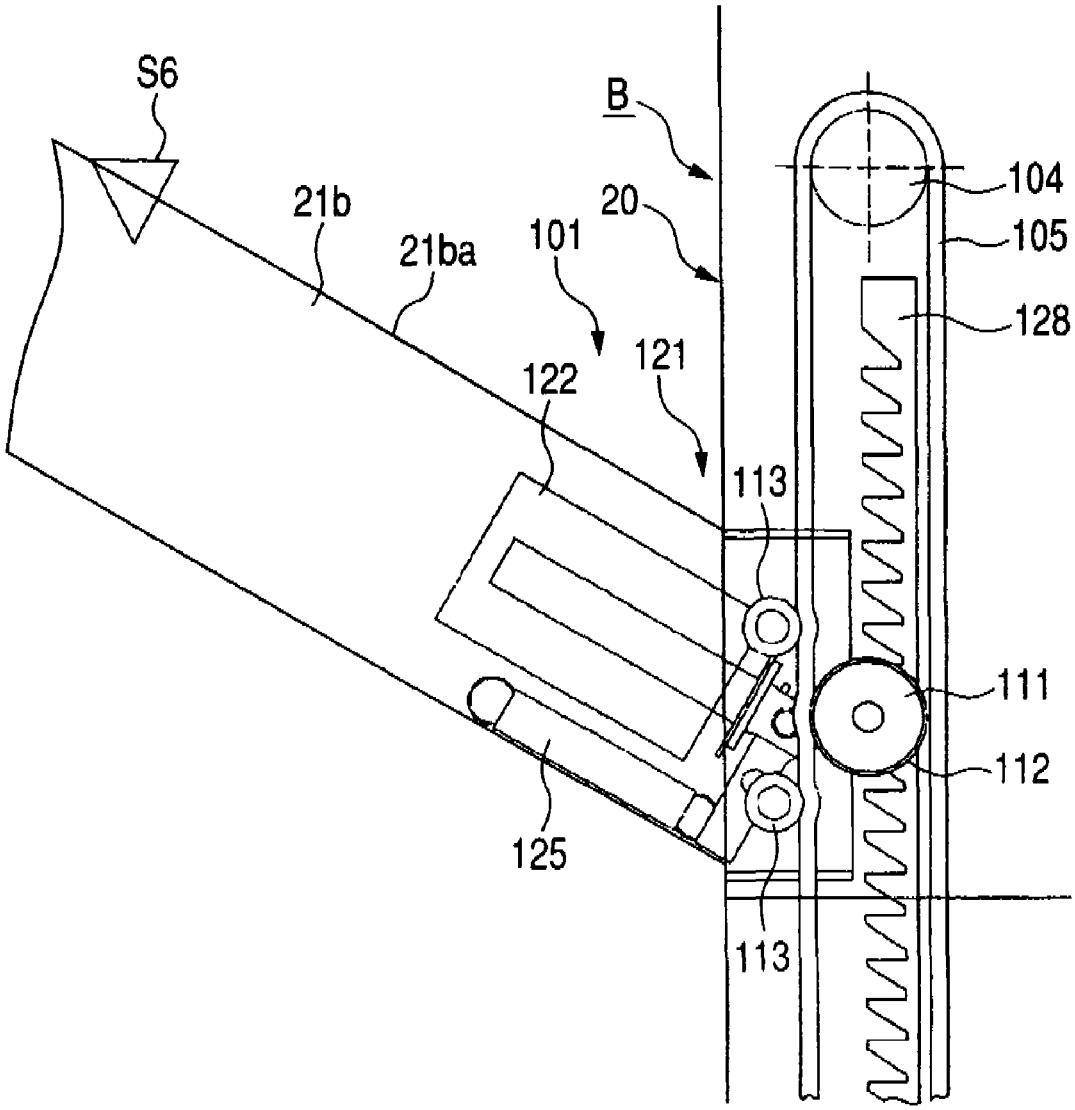
FIG. 3 illustrates a vicinity of a clutch of the sheet stacking device.

As illustrated in FIG. 3, the upper-tray 21*b* includes a clutch 111, the clutch 111 including a large-diameter roller 112. The upper-tray 21*b* is provided with two small-diameter rollers 113 in the upper and lower directions while facing the large-diameter roller 112. The large-diameter roller 112 and the two small-diameter rollers 113 nip the belt 105. The large-diameter roller 112 is rotatable while the clutch 111 is not activated, and stopped being rotated while the clutch 111 is activated. Thus, the upper-tray 21*b* ascends and descends according to the rotation of the belt 105 while the clutch 111 is activated. While the clutch 111 is not activated, the upper-tray 21*b* does not ascend and descend even with the rotation of the belt 105. The clutch 111 as an interrupting unit transmits ascent-and-descent drive of the motor 103 to the upper-tray 21*b* in an active state, and disconnects (interrupts) in an inactive state the transmission of the ascent-and-descent drive of the motor 103 to the upper-tray 21*b*.

The interrupting unit is not limited to the clutch 111, and a gripper for gripping the belt 105 may be substituted for the clutch 111.

The belt 105 is any one of a flat belt and a round belt. A wire or a chain may be substituted for the belt 105. When a chain is used, a large-diameter sprocket and a small-diameter sprocket are substituted for the large-diameter roller 112 and the small-diameter rollers 113, respectively. When a chain and sprockets are used, slips do not occur between the chain and the sprockets. Thus, even when many sheets are stacked on the upper-tray 21*b*, the upper-tray 21*b* is prevented from slip-descending owing to weight of the sheets.

Figure 4:
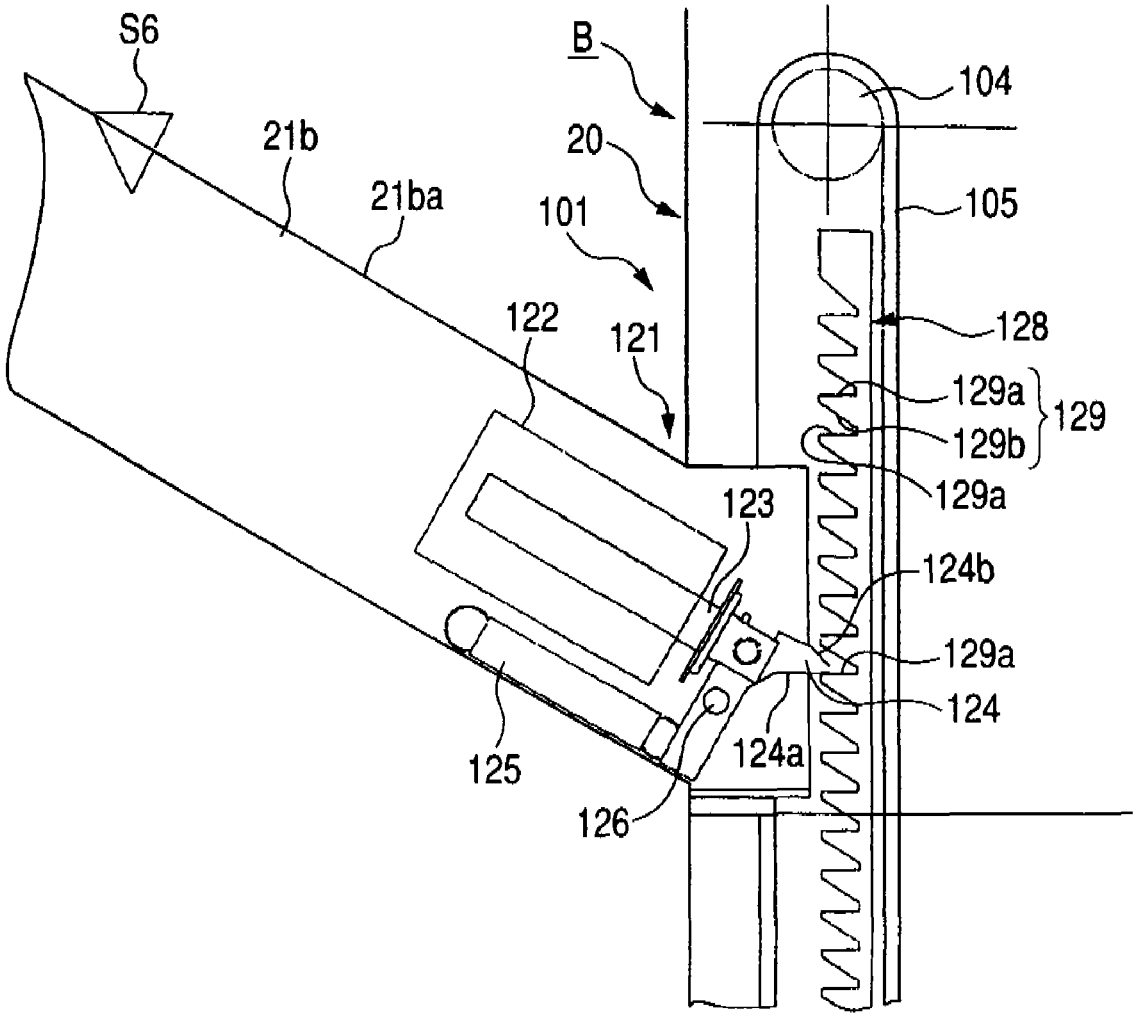
FIG. 4 illustrates an engagement state of a claw and a rack of the sheet stacking device.

When the clutch 111 enters the inactive state, the upper-tray 21*b* descends owing to its self-weight and is superimposed on the lower-tray 21*c*, which leads to a risk of breakage of any one of the upper-tray 21*b* and the lower-tray 21*c*. As a countermeasure, a stopper mechanism 121 as a descent stop unit is provided so that, even when the clutch 111 enters the inactive state, the upper-tray 21*b* does not descend owing to its self-weight (so as to stop self-weight descent). The stopper mechanism 121 illustrated in FIG. 4 is provided between the upper-tray 21*b* and the casing 20.

The stopper mechanism 121 includes a solenoid 122 provided to the upper-tray 21*b*, a spindle 123, a claw 124, a tension spring 125, and a rack 128 fixed to the casing 20.

An intermediate portion of the claw 124 is rotatably provided to a shaft 126 which is provided on the upper-tray 21*b*. The spindle 123 is rotatably coupled to one end of the claw 124. The tension spring 125 is provided between another end of the claw 124 and the upper-tray 21*b*. A horizontal surface 124*a* and an inclined surface 124*b* are formed on the claw 124.

Many teeth 129 are provided to the rack 128 in the upper and lower directions. A horizontal surface 129*a* and an inclined surface 129*b* are formed on each of the teeth 129 as well. The horizontal surface 129*a* and the inclined surface 129*b* are alternately formed.

When the solenoid 122 of the stopper mechanism 121 is in an inactive state (non-energized state), the claw 124 is pulled by the tension spring 125. The claw 124 is rotated clockwise about the shaft 126 in FIG. 4 and engaged with the rack 128. In this state, even if the upper-tray 21*b* may descend owing to its self-weight, the claw 124 is received at the horizontal surface 124*a* thereof by the horizontal surfaces 129*a* of the teeth 129 of the rack 128. As a result, descent of the upper-tray 21*b* is stopped.

When current flows in the solenoid 122 and the solenoid 122 enters the active state, the spindle 123 is attracted to the solenoid 122. Then, the claw 124 counteracts the tension spring 125, and is rotated counterclockwise about the shaft 126 in FIG. 4. The claw 124 is separated from the rack 128, that is, disengaged from the rack 128.

Figure 5:
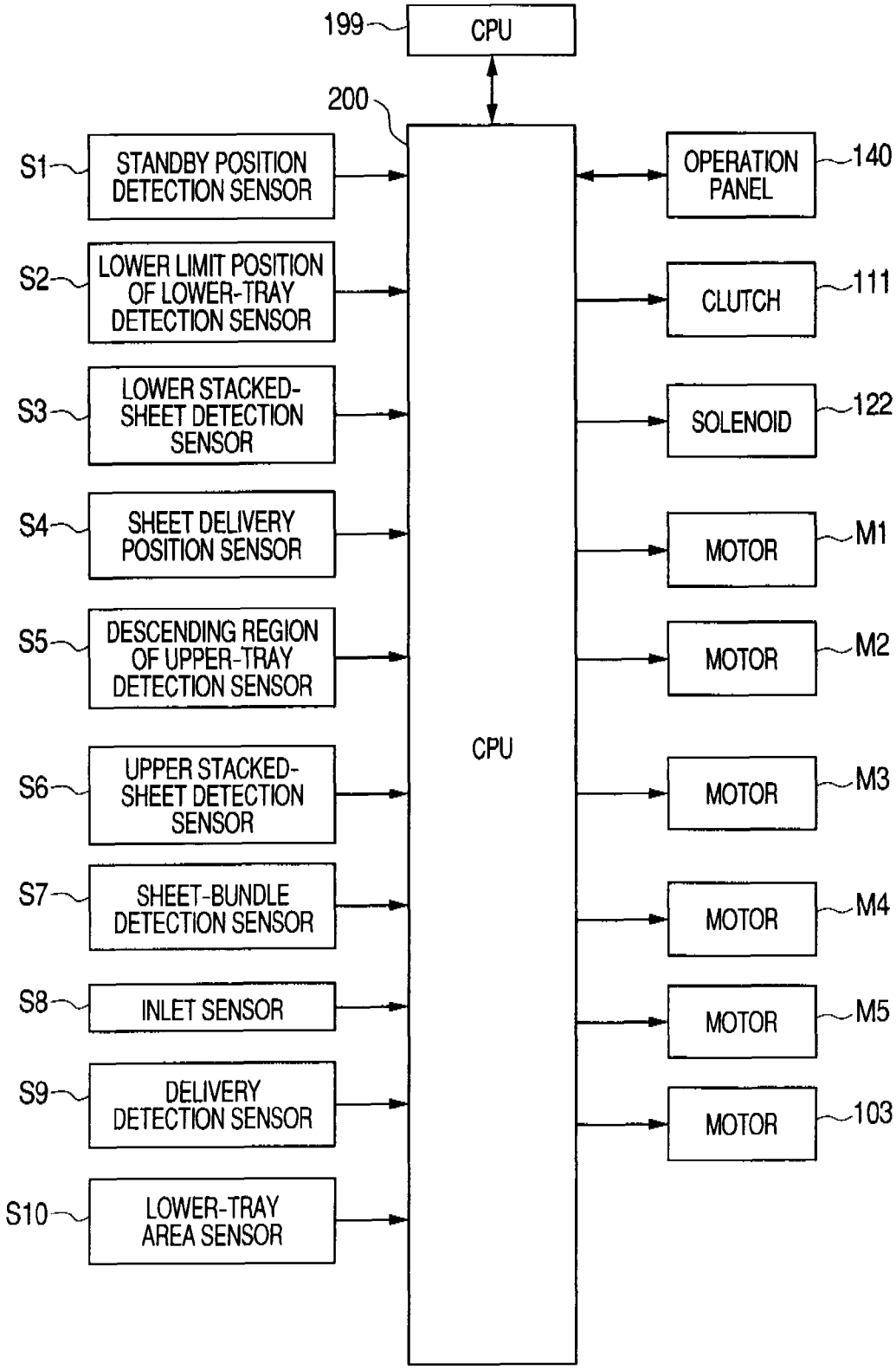
FIG. 5 is a control block diagram of the sheet processing device.

As illustrated in FIG. 5, the following sensors are connected to a CPU 200 for controlling the sheet processing device: a standby position detection sensor S1 for detecting whether or not the upper-tray 21*b* is at an upper-tray standby position H1, a lower limit position of a lower-tray detection sensor S2 for detecting whether or not the lower-tray 21*c* is at a lower-tray descending limit position H2, a lower stacked-sheet detection sensor S3 for detecting whether or not sheets are stacked on the lower-tray 21*c*, a sheet delivery position sensor S4 for positioning the upper-tray 21*b* and the lower-tray 21*c* so that sheets delivered from the delivery roller pair 26 are easily stacked, a descending region of an upper-tray detection sensor S5 for detecting whether or not the upper-tray 21*b* is at a lower limit position in an upper-tray descendible region W, an upper stacked-sheet detection sensor S6 for detecting whether or not the sheets are stacked on the upper-tray 21*b*, a sheet-bundle detection sensor S7 for detecting whether or not the sheet bundle as a book is stacked on the saddle, an inlet sensor S8 for detecting sheets delivered from the apparatus main body A1 of the image forming apparatus, a delivery detection sensor S9 for detecting sheets delivered from the terminal end 25*a* of the first carry-in path R1, and a lower-tray area sensor S10 for detecting whether or not the lower-tray 21*c* is in the upper-tray descendible region W.

The clutch 111, the solenoid 122, and an operation panel 140 (FIG. 1) are also connected to the CPU 200.

The following motors are connected to the CPU 200 as well: the motor 103 for driving the belt 105, a motor M1 for driving each of the rollers, a motor M2 for activating the edge biding stapler 31, a motor M3 for activating a middle binding stapler 33, a motor M4 for activating the folding device 34, and a motor M5 for activating the punching unit 60.

While exchanging control signals, detection signals, and the like with a CPU 199 of the apparatus main body A1, the CPU 200 controls the sheet processing device B and the sheet stacking device 101 provided in the sheet processing device B. One of the CPU 200 and the CPU 199 may be integrated with the other by being incorporated therein.

In the above description, the belt 105, the clutch 111, the solenoid 122, the claw 124, the rack 128, and the like are arranged on each side of a sheet delivery direction of the trays 21*a*, 21*b*, and 21*c*. Two motors 103 may be respectively arranged correspondingly to the belts on both the sides, or both the belts may be driven by one motor 103.

Next, description is made of an operation of the sheet stacking device 101.

When the sheet processing device B is turned off, the clutch 111 is in the inactive state (OFF), and the large-diameter roller 112 is rotatable. Thus, there is a risk that the upper-tray 21*b* descends by its self-weight (self-weight descent). However, current does not flow in the solenoid 122 as well (OFF). Thus, the claw 124 is pulled by the tension spring 125 and engaged with the rack 128, with the result that the self-weight descent of the upper-tray 21*b* is stopped.

Even when the sheet processing device B is turned off, the lower-tray 21*c* is fixed to the belt 105 by the bracket 106. Thus, there is a risk that the lower-tray 21*c* descends by its self-weight while rotating the belt 105. Thus, in the non-energized state, the brake 108 provided to the motor 103 stops rotation of the drive roller 107. The brake 108 stops descent of the lower-tray 21*c*, and hence the lower-tray 21*c* is held at the last stop position.

Figure 9:
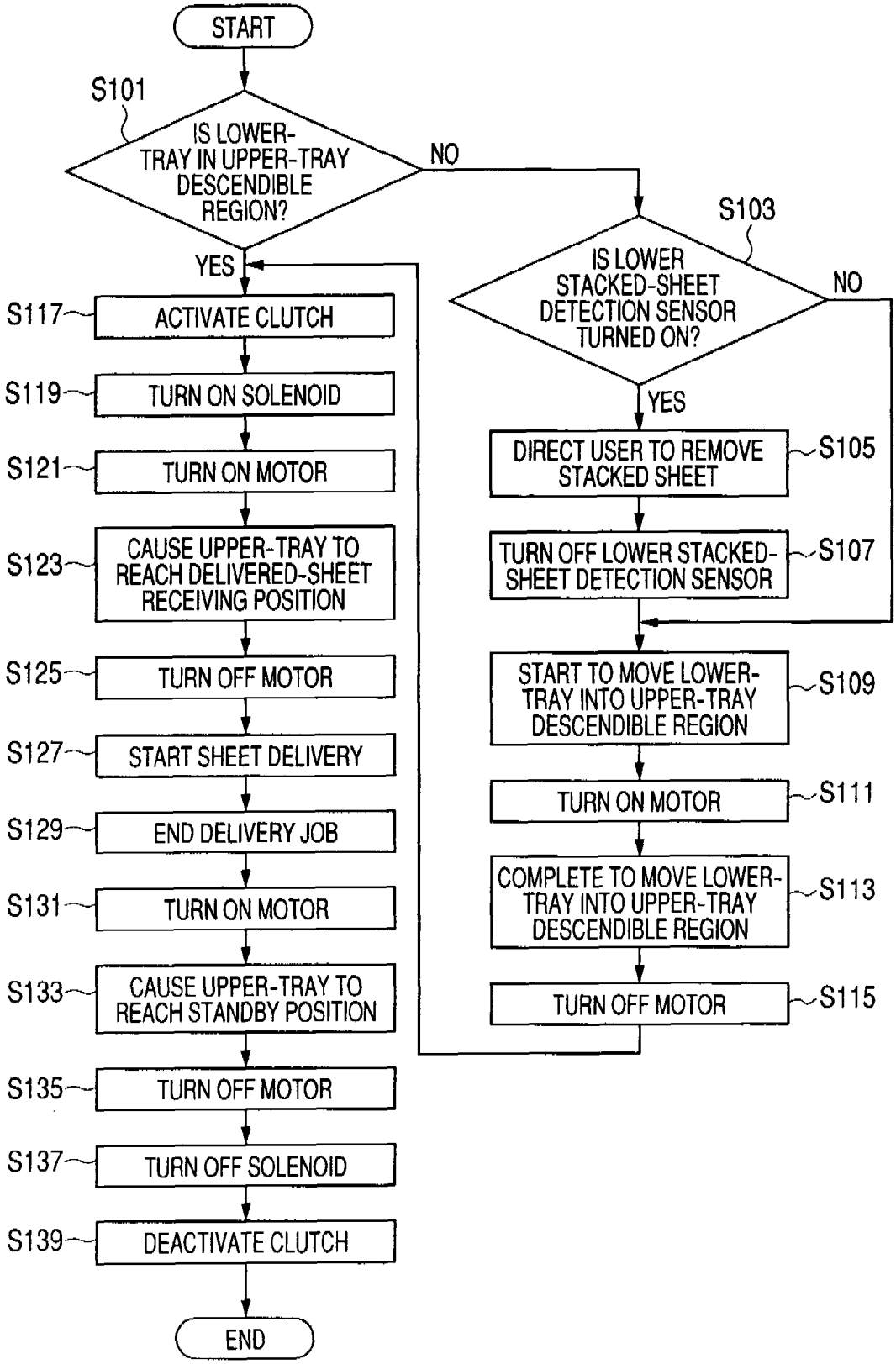
FIG. 9 is a flowchart of sheet stacking control of the sheet stacking device.

Description is made of operations at the time of stacking sheets onto the upper-tray 21*b* with reference to the flowchart of FIG. 9.

The description is made of the operations on the following premises: as illustrated in FIG. 2, the upper-tray 21*b* stands by at the standby position H1 above the delivery roller pair 26; the standby position is detected by the standby position detection sensor S1; the clutch 111 and the solenoid 122 are in the inactive state (OFF); and the upper-tray 21*b* stands by at the standby position H1 freely from a rotational force of the belt 105, with the claw 124 being engaged with the rack 128.

The CPU 200 determines whether or not the lower-tray 21*c* is in the upper-tray descendible region W with reference to whether or not the lower-tray area sensor S10 is turned on (S101). The CPU 200 determines that, when the lower-tray area sensor S10 is turned off, the lower-tray 21*c* is not in the upper-tray descendible region W (NO at S101). The lower-tray area sensor S10, which is provided to the lower-tray 21*c*, is turned on when being shielded by a plate-like shield (not shown) vertically provided to the casing 20 and is turned off when not being shielded thereby. The shield is structured so that the lower-tray area sensor S10 is turned on in the upper-tray descendible region W. The upper-tray descendible region W is equivalent to a region of from a position at which a sheet stacking surface 21*ba* of the upper-tray 21*b* is detected by the standby position detection sensor S1 to a position at which a lower portion of the upper-tray 21*b* is detected by the descending region of an upper-tray detection sensor S5. The upper-tray 21*b* is ascendible and descendible within regions above and below the delivery roller pair 26. The lower-tray 21*c* is ascendible and descendible within a region below the delivery roller pair 26.

When the lower stacked-sheet detection sensor S3 is turned on (YES at S103), the CPU 200 determines that sheets are stacked on the lower-tray 21*c*. In this case, the sheets stacked on the lower-tray 21*c* are probably stacked up to the vicinity of the delivery roller pair 26 as illustrated in FIG. 2. In this state, the upper-tray 21*b* cannot be used.

The CPU 200 displays, on the operation panel 140 (FIG. 1), directions to a user to remove the stacked sheets (S105). When the user removes the stacked sheets, the lower stacked-sheet detection sensor S3 is turned off (S107).

Figure 6:
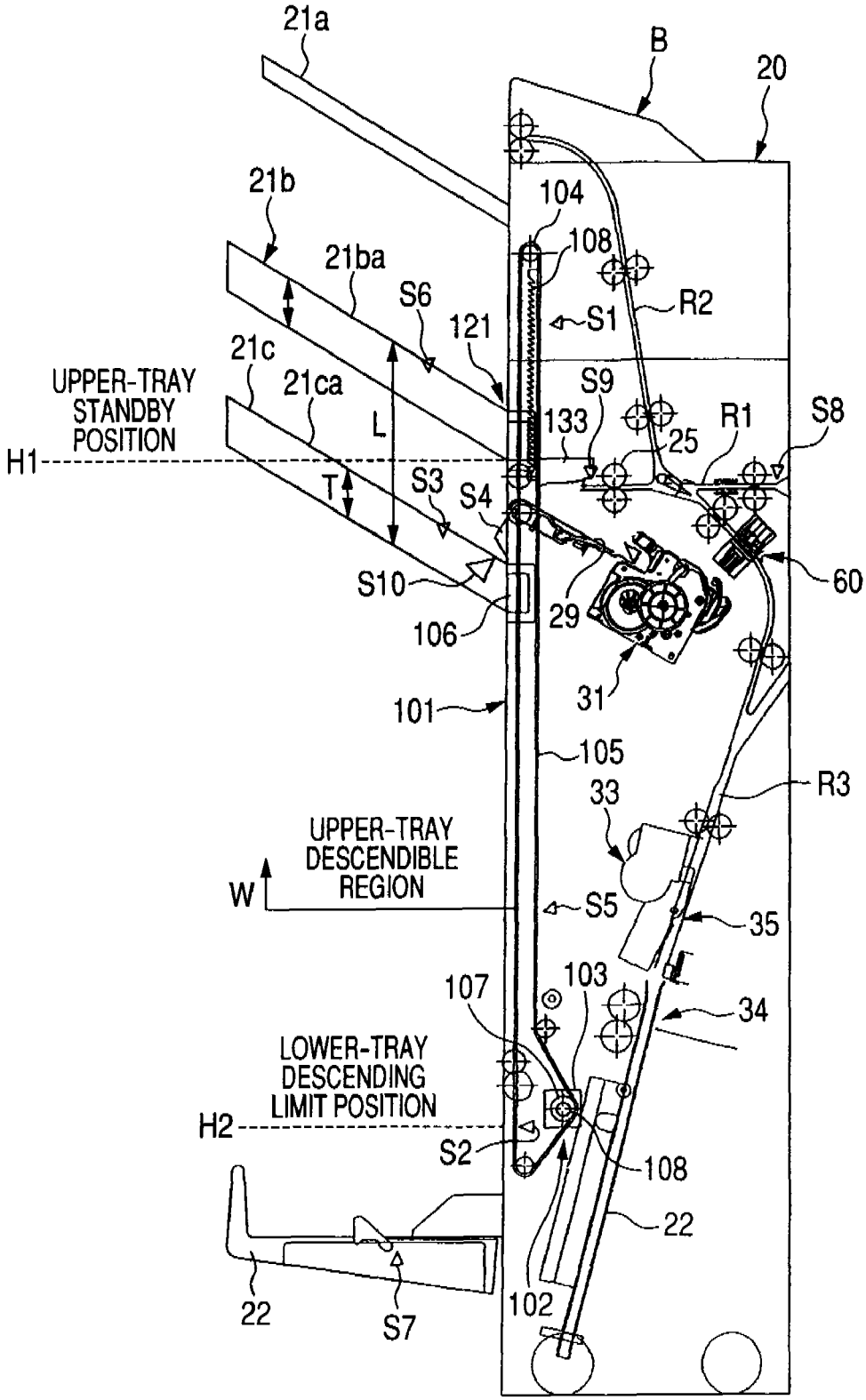
FIG. 6 is an operational explanatory diagram of the sheet stacking device, illustrating a state in which a lower-tray is brought close to an upper-tray in an unascendible state.

After that, as illustrated in FIG. 6, the CPU 200 turns on the motor 103 so that the lower-tray 21*c* is caused to ascend into the upper-tray descendible region W (S109 and S111). When the lower-tray 21*c* is detected by the sheet delivery position sensor S4, the CPU 200 stops ascent of the lower-tray 21*c* (S113 and S115). As a result, the lower-tray 21*c* moves toward the upper-tray 21*b* standing by at the upper-tray standby position H1, and a clearance between the lower-tray 21*c* and the upper-tray 21*b* can be reduced.

At S103, when the sheets are not stacked on the lower-tray 21*c* (NO at S103), the CPU 200 proceeds to the process of S109.

After that, the CPU 200 proceeds to S117.

Figure 7:
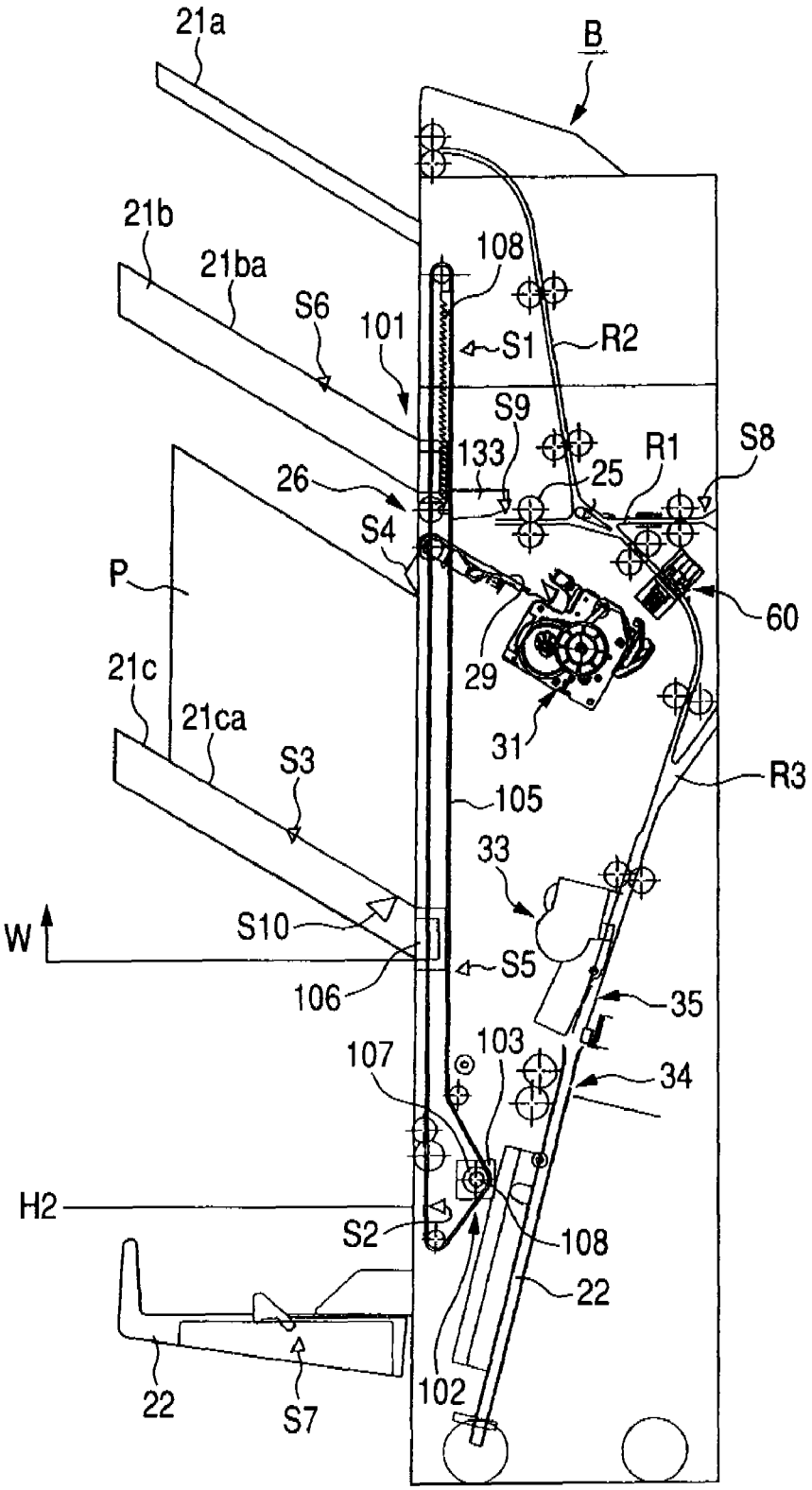
FIG. 7 is an operational explanatory diagram of the sheet stacking device, illustrating a state in which the lower-tray is in an upper-tray descendible region.

At S101, the CPU 200 determines that, when the lower-tray 21*c* is not detected by the lower limit position of a lower-tray detection sensor S2 or is detected by the descending region of an upper-tray detection sensor S5, the lower-tray 21*c* is in the upper-tray descendible region W (YES at S101). That is, the CPU 200 determines that the lower-tray 21*c* is positioned as illustrated in FIG. 7. In this case, the sheets P may be stacked on the lower-tray 21*c*.

After that, the CPU 200 activates the clutch 111 (ON at S117), couples the upper-tray 21*b* to the belt 105, turns on the solenoid 122 (ON at S119), and disengages the claw 124 (FIG. 4) from the rack 128. In this manner, the upper-tray 21*b* is allowed to ascend and descend according to the rotation of the belt 105.

Figure 8:
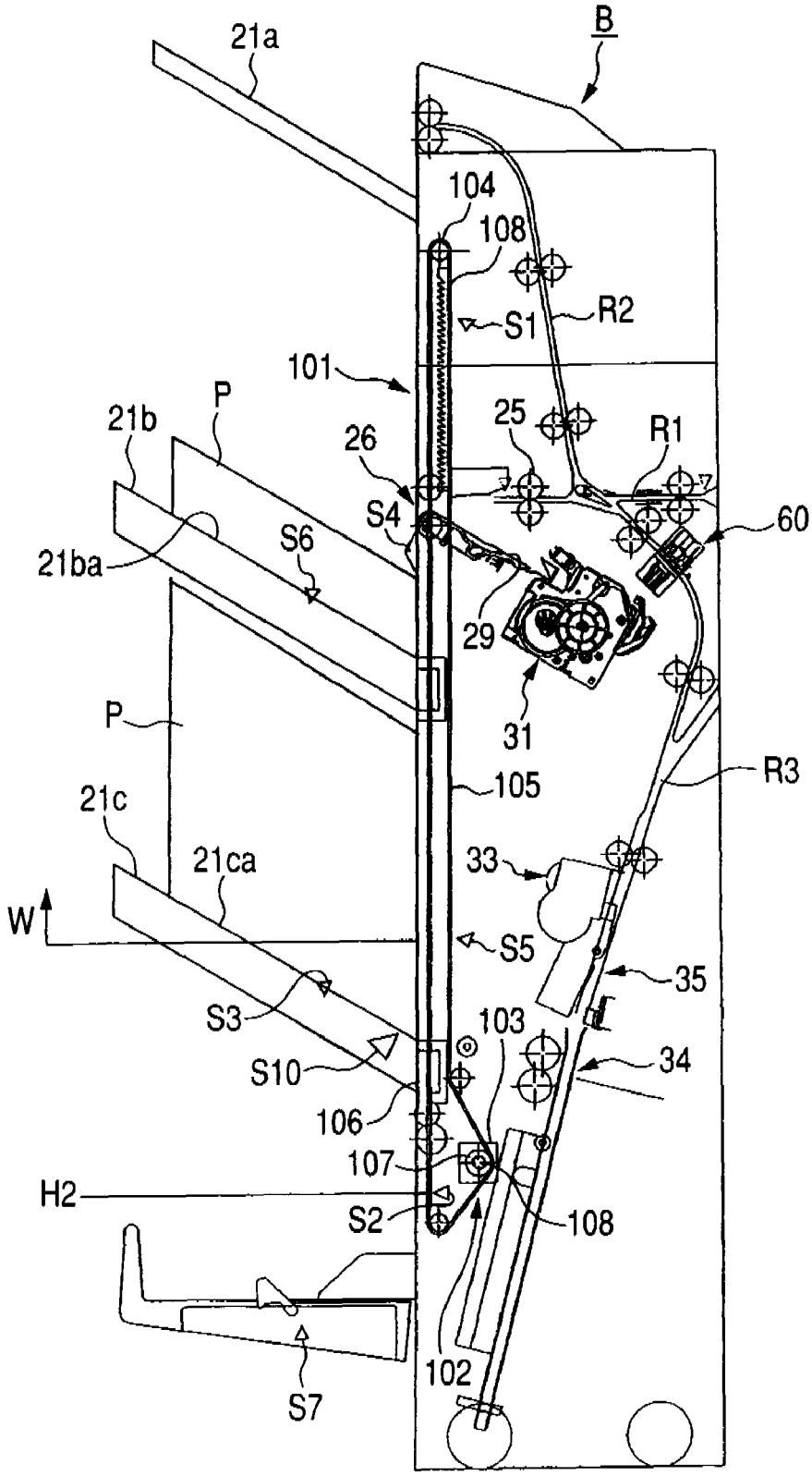
FIG. 8 is an operational explanatory diagram of the sheet stacking device, following FIG. 7 and illustrating a state in which sheets are stacked on the upper-tray.

The CPU 200 turns on the motor 103 (S121). As a result, the upper-tray 21*b* and the lower-tray 21*c* descend integrally with each other, with the clearance therebetween being maintained. When the sheet stacking surface 21*ba* of the upper-tray 21*b* is detected by the sheet delivery position sensor S4 (S123), the CPU 200 turns off the motor 103 (S125). After that, the processed sheets start to be delivered from the delivery roller pair 26 and stacked onto the upper-tray 21*b* (S127). The CPU 200 controls the motor 103, and allows the upper-tray 21*b* to descend as illustrated in FIG. 8 as the number of the sheets stacked on the upper-tray 21*b* increases. With this configuration, the uppermost sheet is always detected by the sheet delivery position sensor S4. After that, a delivery job is ended (S129).

The CPU 200 reversely rotates the motor 103 so as to allow the upper-tray 21*b* and the lower-tray 21*c* to ascend (S131). When the upper-tray 21*b* is detected by the standby position detection sensor S1 (S133), the CPU 200 turns off the motor 103 (S135). The CPU 200 brings the solenoid 122 into the inactive state (OFF) (S137). The claw 124 is engaged with the rack 128 so as to stop the descent of the upper-tray 21*b*. After that, the CPU 200 brings the clutch 111 into the inactive state (OFF) (S139) so as to disconnect the upper-tray 21*b* and the belt 105 from each other.

As described above, the sheet stacking device 101 is capable of changing a state of a clearance L from that illustrated in FIG. 2 into that illustrated in FIG. 6, the clearance L being defined between the sheet stacking surface 21*ba* of the upper-tray 21*b* and a sheet stacking surface 21*ca* of the lower-tray 21*c*. Meanwhile, the sheet stacking device 101 is capable of disconnecting the upper-tray 21*b* and the belt 105 from each other and changing the state of the clearance L from that illustrated in FIG. 6 into that illustrated in FIG. 2. That is, the sheet stacking device 101 is capable of adjusting the clearance L between the upper-tray 21*b* and the lower-tray 21*c*.

Unlike conventional ones, the upper-tray 21*b* does not include an ascending and descending motor. Thus, a thickness T in an ascending and descending direction is small, and hence the distance L (FIG. 6) between the sheet stacking surface 21*ba* of the upper-tray 21*b* and the sheet stacking surface 21*ca* of the lower-tray 21*c* can be reduced. As a result, the upper-tray descendible region W in a case where the upper-tray 21*b* descends while stacking sheets can be widely secured, and hence a larger number of sheets can be stacked on the upper-tray 21*b*. Similarly to the upper-tray 21*b*, the thickness T of the lower-tray 21*c* is reduced as well. Thus, in the state of FIG. 2, the lower-tray descending limit position H2 can be lowered in comparison with those in conventional cases, and hence a larger number of sheets can be stacked on the lower-tray 21*c*.

Unlike conventional ones, the upper-tray 21*b* and the lower-tray 21*c* do not include an ascending motor. Thus, the upper-tray 21*b* and the lower-tray 21*c* are reduced in weight, and hence a mechanism for supporting the trays in an ascending and descending manner can be simplified and downsized.

Although the clutch 111, the stopper mechanism 121, and the like described above are provided only to the upper-tray 21*b*, it is only necessary that those members be provided at least one of the upper-tray 21*b* and the lower-tray 21*c*. Further, the above-mentioned arrangement of the trays is not limited to two stages of the upper stage and the lower stage. It is only necessary that the clutch 111, the stopper mechanism 121, and the like be provided to at least one of the trays provided on multiple stages. The total thickness of the trays can be reduced also in those cases. Thus, the clearance between the trays can be reduced, with the result that the descending region of the tray can be enlarged and a larger amount of sheets can be stacked.

The sheet processing device B described above includes the sheet stacking device 101 in which a larger number of sheets can be stacked. Thus, sheets are less frequently taken out from the upper-tray 21*b* and the lower-tray 21*c*, and hence the sheet processing device B can be more easily handled. In addition, as the sheets are less frequently taken out, the sheet processing device B is less frequently stopped. Thus, the sheet processing device B can be operated with higher operational availability.

The image forming apparatus includes the sheet stacking device 101 as well in which a larger number of sheets can be stacked. Thus, sheets are less frequently taken out from the upper-tray 21*b* and the lower-tray 21*c*, and hence the image forming apparatus can be more easily handled. In addition, as the sheets are less frequently taken out, the image forming apparatus is less frequently stopped. Thus, the image forming apparatus can be operated with higher operational availability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-231017, filed Oct. 2, 2009, which is hereby incorporated by reference herein in its entirety.

What is claimed is:

1. A sheet stacking device, comprising:

an upper stacking portion and a lower stacking portion, the lower stacking portion provided under the upper stacking portion, said upper stacking portion and said lower stacking portion mounted for ascending and descending movement, and on which sheets delivered from a sheet delivery portion are stacked;

a drive portion which is configured to drive the upper stacking portion and the lower stacking portion to ascend and descend;

a connecting portion which is provided between the upper stacking portion and the drive portion, and configured to connect the upper stacking portion and the drive portion to each other;

a descent stop portion which is configured to stop a self-weight descent of the upper stacking portion in a state where the connecting portion is disconnected from the drive portion;

a sheet detection sensor which detects whether or not sheets are stacked on the lower stacking portion;

a position detection sensor which detects whether or not the lower stacking portion is in a movable region which is under the sheet delivery portion and in which the upper stacking portion is descendible; and a control portion which controls the drive portion, the connecting portion and the descent stop portion based on a detection result of the sheet detection sensor and the position detection sensor;

wherein the lower stacking portion is directly connected with the drive portion and always ascendible and descendible, in a case that the upper stacking portion is moved from a standby position which is above the sheet delivery portion to a receiving position at which sheets delivered from a sheet delivery portion are received and where the lower stacking portion is detected in the movable region by the position detection sensor, the control portion causes the connecting portion to connect the upper stacking portion and the drive portion, causes the disengagement of the descent stop portion, and causes the drive portion to move the upper stacking portion to the receiving position by integrally moving the upper stacking portion and the lower stacking portion, in a case that the upper stacking portion is moved from the standby position to the receiving position, where the lower stacking portion is not detected in the movable region by the position detection sensor and the stacked sheet on the lower stacking portion is not detected by the sheet detection sensor, the control portion causes the connecting portion to connect the upper stacking portion and the drive portion after raising the lower stacking portion to a predetermined position in the movable region by the drive portion and causes the upper stacking portion to move to the receiving position by integrally lowering the upper stacking portion and the lower stacking portion by the drive portion after disengaging the descent stop portion, and in a case that the upper stacking portion is moved from the standby position to the receiving position and where the lower stacking portion is not detected in the movable region by the position detection sensor and the sheet stacked on the lower stacking portion is detected by the sheet detection sensor, the control portion does not cause driving of the drive portion.

2. A sheet processing device, comprising:

a sheet processing portion configured to process sheets; and the sheet stacking device according to claim 1 in which the sheets processed by the sheet processing portion are stacked.

3. An image forming apparatus, comprising:

an image forming portion configured to form images on sheets; and the sheet stacking device according to claim 1 in which the sheets subjected to image formation by the image forming portion are stacked.

* * * * *